US006837201B1

(12) United States Patent
Cheng

(10) Patent No.: US 6,837,201 B1
(45) Date of Patent: Jan. 4, 2005

(54) APPARATUS AND METHOD FOR LESSENING THE ACCUMULATION OF HIGH BOILING FRACTION FROM FUEL IN INTAKE VALVES OF COMBUSTION ENGINES

(75) Inventor: Shi-Wai S. Cheng, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/691,092

(22) Filed: Oct. 22, 2003

(51) Int. Cl.[7] ..... F01M 1/06

(52) U.S. Cl. ..... 123/90.33; 123/90.35; 123/188.1

(58) Field of Search ..... 123/90.33, 90.35, 123/90.37, 188.1, 188.2, 188.5, 188.9, 188.11

(56) References Cited

U.S. PATENT DOCUMENTS 3,909,214 A * 9/1975 Polss ..... 44/380
4,082,224 A * 4/1978 Mangus ..... 239/453
4,968,321 A 11/1990 Sung et al. ..... 44/337
5,005,541 A * 4/1991 Yamamoto et al. ..... 123/90.35
5,904,125 A * 5/1999 Enright et al. ..... 123/188.3
5,951,723 A 9/1999 Eberhard ..... 44/387
6,348,075 B1 2/2002 Jackson ..... 44/432

* cited by examiner

*Primary Examiner*—Thomas Denion
*Assistant Examiner*—Ching Chang
(74) *Attorney, Agent, or Firm*—Kathryn A. Marra

(57) ABSTRACT

An intake valve for a combustion engine having an oil reservoir and adapted for combusting fuel is disclosed. The intake valve includes a valve stem and a valve guide arranged proximate the valve stem. The valve guide and valve stem define a first clearance dimension and a second clearance dimension between an inner surface of the valve guide and an outer surface of the valve stem, wherein the second clearance dimension is greater than the first clearance dimension. The second clearance dimension is sized to accept a volume of oil quantified to dissolve high boiling fraction from the fuel to lessen the accumulation of high boiling fraction between the valve stem and the valve guide.

15 Claims, 4 Drawing Sheets

APPARATUS AND METHOD FOR LESSENING THE ACCUMULATION OF HIGH BOILING FRACTION FROM FUEL IN INTAKE VALVES OF COMBUSTION ENGINES

BACKGROUND OF THE INVENTION

The present disclosure relates generally to an apparatus and method for lessening the accumulation of high boiling fraction from fuel in combustion engines, and particularly to an intake valve for a combustion engine configured to lessen the accumulation of the high boiling fraction at the intake valve.

A gasoline-fueled spark-ignition combustion engine traditionally has the fuel introduced into the intake system either through a carburetor or a port fuel injector. Some fuels contain high boiling materials, or fractions, such as polymer fuel additives or gum, and some of the high boiling fractions have a high viscosity, which generally increases exponentially with a decrease in temperature. Consequently, after an engine cools down, an accumulation of high viscosity high boiling fraction on the intake valve surfaces may result. Accordingly, there is a need in the art for an intake system in a combustion engine that may lessen the accumulation of high boiling fraction on intake valve surfaces.

SUMMARY OF THE INVENTION

In one embodiment, an intake valve for a combustion engine having an oil reservoir and adapted for combusting fuel is disclosed. The intake valve includes a valve stem and a valve guide arranged proximate the valve stem. The valve guide and valve stem define a first clearance dimension and a second clearance dimension between an inner surface of the valve guide and an outer surface of the valve stem, wherein the second clearance dimension is greater than the first clearance dimension. The second clearance dimension is sized to accept a volume of oil quantified to dissolve high boiling fraction from the fuel to lessen the accumulation of high boiling fraction between the valve stem and the valve guide.

In another embodiment, a valve guide for an intake valve of a combustion engine includes a surface for guiding a valve stem and a channel formed in the surface for receiving oil from an oil reservoir. The channel is sized to receive a volume of oil quantified to dissolve high boiling fraction from fuel to lessen the accumulation of high boiling fraction between the valve stem and the surface for guiding the valve stem.

In a further embodiment, a method for dissolving or diluting high boiling fraction from fuel at an intake valve stem of a combustion engine is disclosed. A volume of oil is passed from a first end of a valve guide toward a second end thereof through a first channel disposed between the valve stem and the valve guide, and the volume of oil is received at a second channel disposed at the second end of the valve guide. The volume of oil is quantified to dissolve high boiling fraction from fuel to lessen the accumulation of high boiling fraction between the valve stem and the valve guide.

BRIEF DESCRIPTION OF THE DRAWINGS

Referring to the exemplary drawings wherein like elements are numbered alike in the accompanying figures.

DETAILED DESCRIPTION OF THE INVENTION

An embodiment of the invention provides an intake valve for a combustion engine, the intake valve being structured to reduce the accumulation of high boiling fraction between a valve stem and a valve guide. While an embodiment described herein depicts a linear piston and cylinder arrangement as an exemplary combustion system for the combustion engine, it will be appreciated that the disclosed invention may also be applicable to other combustion systems, such as a rotary combustion system employed in a rotary combustion engine for example.

Figure 1:
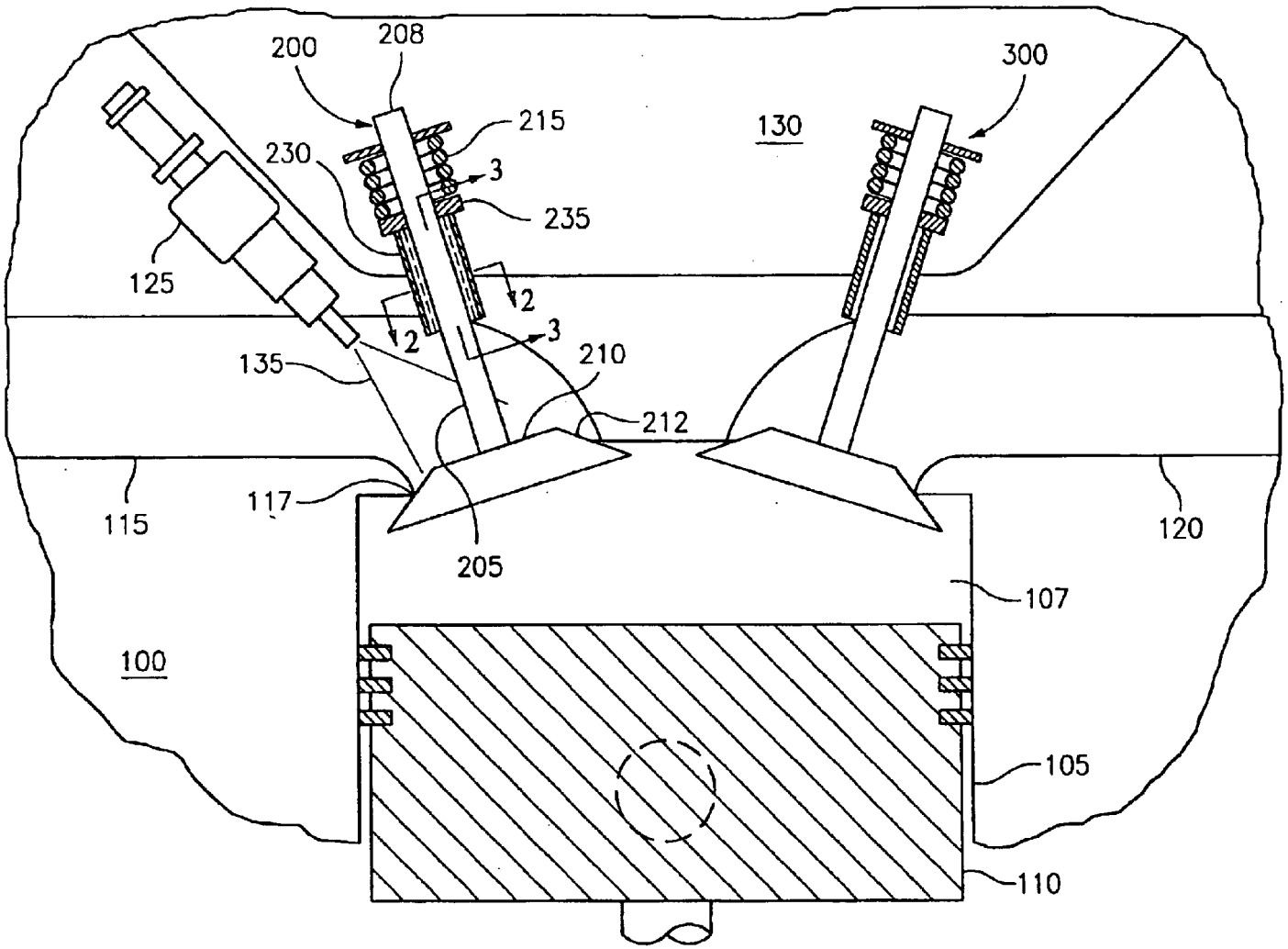
FIG. 1 depicts an exemplary combustion system in accordance with an embodiment of the invention.
Figure 2:
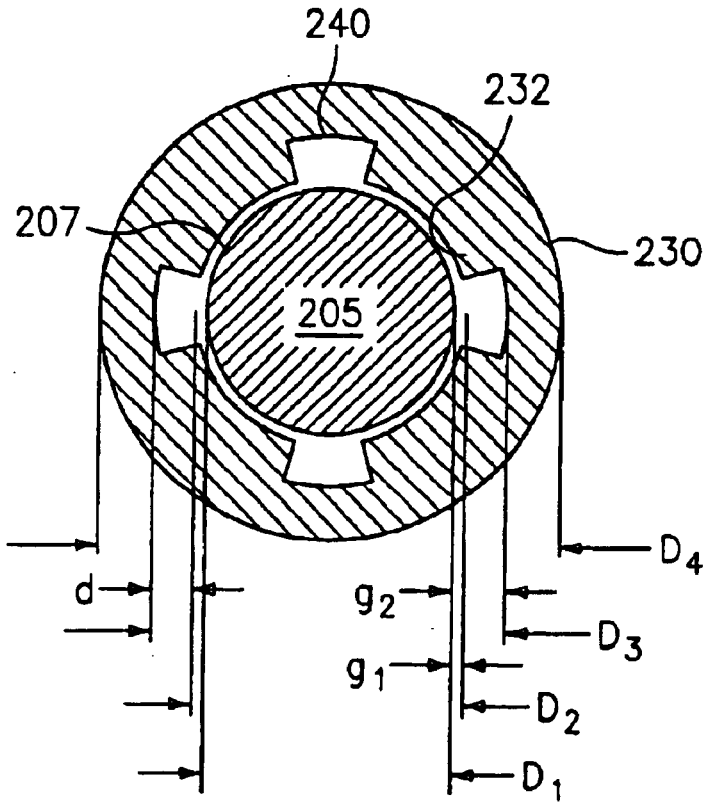
FIG. 2 depicts an axial cross section view of an embodiment of the invention.

FIG. 1 is an exemplary embodiment of a combustion system 100 for a combustion engine (not shown) having a cylinder 105 and a piston 110 defining a combustion chamber 107, an intake port 115, an exhaust port 120, a fuel supply 125, such as a fuel injector for example, an intake valve 200, and an exhaust valve 300. In an embodiment, intake valve 200 includes a valve stem 205, and a valve head 210 (also referred to as a valve tulip) that has a seating surface 212 that seats against an intake valve seat 117 at intake port 115 during the opening and closing action of intake valve 200. Surrounding valve stem 205 is a valve guide 230 that is dimensioned in close relationship with valve stem 205 for guiding the movement of valve stem 205 during the opening and closing action of intake valve 200, best seen by referring to FIG. 2, which depicts an axial cross section view of an embodiment of valve stem 205 and valve guide 230 having exaggerated dimensions for clarity and discussion purposes. Referring briefly to FIG. 2, the clearance dimension g1 between an inner surface 232 of valve guide 230 (diameter D2) and an outer surface 207 of valve stem 205 (diameter D1) is herein referred to as a first clearance dimension. Other dimensions depicted in FIG. 2 will be discussed in more detail later. Referring back to FIG. 1, at the top of valve guide 230 is a valve seal 235 for controlling the flow of oil from an oil reservoir, generally depicted as 130 in the combustion engine, to clearance dimension g1 between valve stem 205 and valve guide 230, which assists in the control of oil consumption. The end 208 of valve stem 205 is arranged in mechanical communication with a valve cam (not shown) of the combustion engine for driving intake valve 200 to an open position. Intake valve 200 is driven to a closed position by the action of a valve spring 215.

An exemplary operational cycle of combustion system 100 begins with intake valve 200 being closed, that is, with seating surface 212 seated against valve seat 117, and fuel injector 125 providing a supply of fuel to intake port 115 where it is mixed with air. As depicted in the exemplary embodiment of FIG. 1, the spray 135 of the fuel is directed toward valve stem 205 and valve tulip 210. In response to intake valve 200 being opened via the valve cam, the fuel and air mixture is permitted to enter combustion chamber 107, whereafter valve spring 215 drives intake valve 200 to the closed position and timed combustion and exhaust take place.

During the combustion cycle, outer surface 207 of valve stem 205 is at an elevated temperature, which results in the evaporation of the low boiling fraction of the fuel and the adhesion to outer surface 207 of the high boiling fraction of the fuel. With a portion of valve stem 205 moving in and out of valve guide 230 over many combustion cycles, some of the high boiling fraction on valve stem 205 may be pushed into clearance dimension g1 between valve stem 205 and valve guide 230.

Referring now to FIG. 2, the accumulation of the high boiling fraction (also referred to as residue or gum) at clearance dimension g1 may be lessened by introducing a channel or groove 240 in valve guide 230 that is sized to accept a volume of oil, via oil reservoir 130 and valve seal 235 (FIG. 1), quantified to dissolve the high boiling fraction. As used herein, the term dissolve is intended to convey any degree of dissolving or diluting of the fraction, and is not intended to imply a fraction that is 100% dissolved. In an embodiment, a preferred volume ratio of oil to high boiling fraction suitable for dissolving the high boiling fraction is equal to or less than about eight-to-one, with a more preferred volume ratio being equal to or less than about five-to-one, and an even more preferred volume ratio being equal to or less than about three-to-one. As depicted in FIG. 2, channel 240 may be trapezoid-shaped with tops and bottoms defined by diameters D2 and D3, respectively, thereby defining a plurality of channels than run parallel to the central axis of valve stem 205. However, channel 240 is not limited to a particular shape or number channels, but is rather configured appropriately for the function described herein. Diameters D1 and D3 define a clearance dimension g2, which is herein referred to as a second clearance dimension, and since clearance dimension g1, which is sized for valve clearance, is substantially smaller than clearance dimension g2, which is sized of dissolution of the high boiling fraction, the depth d of channels 240 is a substantial portion of clearance dimension g2. In an embodiment, clearance dimension g2 is approximately five times clearance dimension g1. While the embodiment described herein depicts channel 240 on valve guide 230, it will be appreciated that channel 240 may alternatively be applied to valve stem 205.

Figure 3:
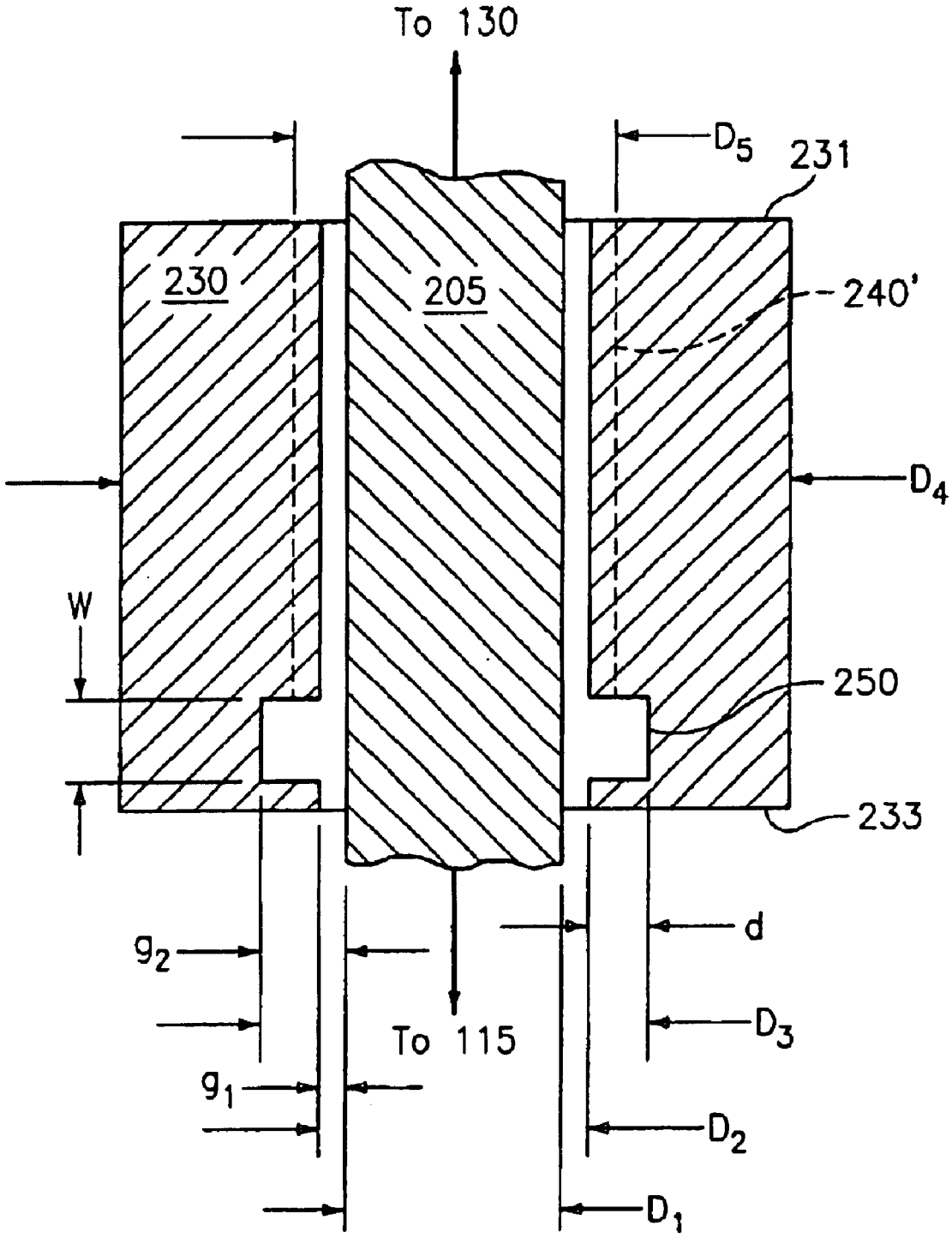
FIG. 3 depicts a longitudinal cross section view of an alternative embodiment of the invention.

Referring now to FIG. 3, a longitudinal cross section view of an alternative embodiment of valve stem 205 and valve guide 230, having exaggerated dimensions for clarity and discussion purposes, is depicted. In FIG. 3, diameters D2 and D3 now define the depth d of channel 250, which is a ring-like channel disposed proximate the end 233 of valve guide 230. As with channel 240, channel 250 is sized to accept a volume of oil, via oil reservoir 130 and valve seal 235, quantified to dissolve the high boiling fraction. The width w and depth d of channel 250 are appropriately sized to provide the preferred 8:1, more preferred 5:1, or even more preferred 3:1, volume ratio of oil to high boiling fraction. In an embodiment, the dimension of clearance dimension g2, defined by diameters D1 and D3, is about five times the dimension of clearance dimension g1. The embodiments of FIGS. 2 and 3 may be combined to provide a valve guide 230 with both trapezoid-shaped (or equivalently shaped, such as triangle-shaped for example) channels 240', as depicted by dashed lines in FIG. 3, and a ring-like channel 250, with the diameter D5 of channels 240' being equal to or other than diameter D3. In the combination embodiment, oil from oil reservoir 130 may flow to ring-like channel 250 via trapezoid-shaped channel 240', thereby placing the oil at a location close to where the high boiling fraction tends to accumulate.

Figure 4:
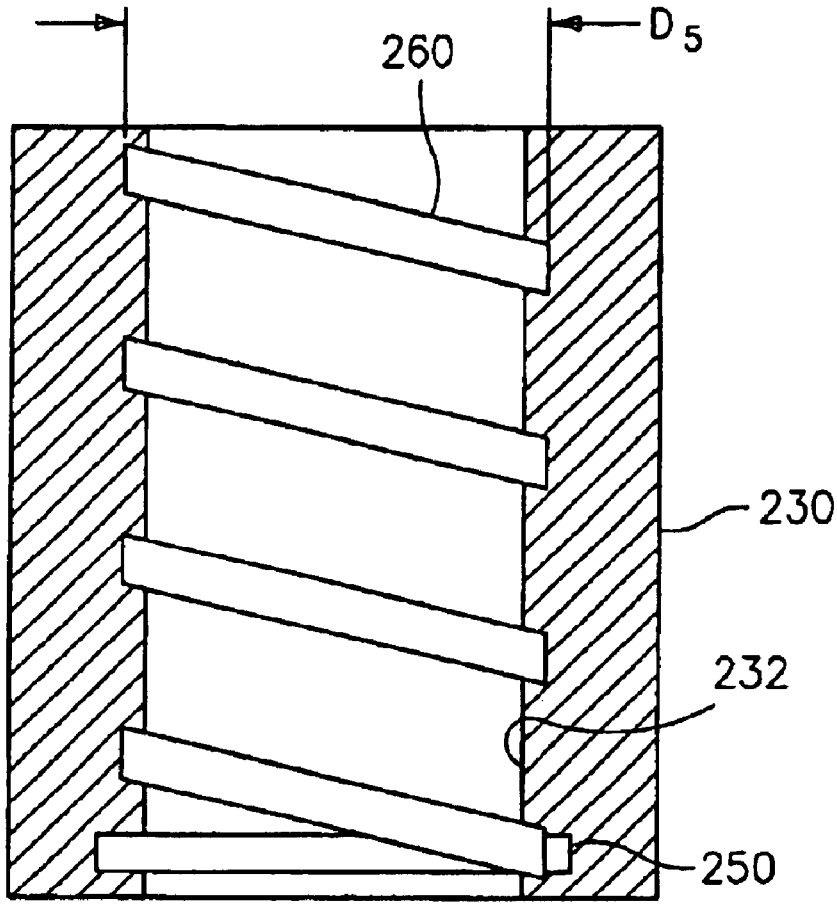
FIG. 4 depicts a longitudinal cross section view of a further alternative embodiment of the invention.

In an alternative embodiment, and now referring to FIG. 4 depicting a longitudinal cross section view of valve guide 230, channels 240 may be replaced with channels 260 that are spiral-shaped around the inner surface 232 of valve guide 230. In yet a further embodiment, channels 240, 250, and 260, may be combined in any combination suitable for the purpose described herein.

In view of the foregoing, combustion system 100, employing an embodiment of the invention, dissolves high boiling fraction from the combustible fuel by passing a volume of oil from oil reservoir 130 through valve seal 235 at a first end 231 of valve guide 230, through a channel 240', to a channel 250 proximate a second end 233 of valve guide 230. The volume of oil received at channel 250 is quantified to dissolve the high boiling fraction, thereby lessening the accumulation of high boiling fraction between valve stem 205 and valve guide 230.

While an embodiment of the invention has been described employing a fuel injection system for supplying fuel, it will be appreciated that the scope of the invention is not so limited, and that the invention may also apply to a carburetor fuel delivery system.

As disclosed, some embodiments of the invention may include some of the following advantages: reduced accumulation of high boiling fraction on intake valve surfaces; reduced accumulation of high boiling fraction between the valve stem and valve guide; reduced surface contact area between moving parts, thereby reducing surface friction; and, increased lubrication between moving parts, thereby reducing system friction losses.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An intake valve for a combustion engine having an oil reservoir and adapted for combusting fuel, the intake valve comprising:

a valve stem; and a valve guide arranged proximate the valve stem, the valve guide and valve stem defining a first clearance dimension and a second clearance dimension between an inner surface of the valve guide and an outer surface of the valve stem, the second clearance dimension being greater than the first clearance dimension;

wherein the second clearance dimension is sized to accept a volume of oil quantified to dissolve high boiling fraction from the fuel to lessen the accumulation of high boiling fraction between the valve stem and the valve guide.

2. The intake valve of claim 1, further comprising a channel having a depth defined by the first and second clearance dimensions, the channel sized to accept the volume of oil and disposed in fluid communication with the oil reservoir.

3. The intake valve of claim 2, wherein the channel comprises a plurality of channels extending at least a portion of the length of the valve guide.

4. The intake valve of claim 2, wherein the channel comprises a spiral extending from a point proximate a first end to a point proximate a second end of the valve guide.

5. The intake valve of claim 2, wherein the channel comprises a ring-like shape disposed proximate the second end of the valve guide.

6. The intake valve of claim 1, further comprising:

a third clearance dimension between the inner surface of the valve guide and the outer surface of the valve stem, the third clearance dimension being greater than the first clearance dimension;

a first channel defined by the first and third clearance dimensions, the first channel arranged in fluid communication with the oil reservoir at a first end of the valve guide;

a second channel defined by the first and second clearance dimensions, the second channel comprising a ring-like shape sized to accept the volume of oil and disposed proximate the second end of the valve guide and arranged in fluid communication with the first channel;

wherein oil from the oil reservoir is permitted to travel to the second channel via the first channel thereby providing a volume of oil at the second channel quantified to dissolve the high boiling fraction from the fuel.

7. The intake valve of claim 1, wherein the second clearance dimension is about five times the size of the first clearance dimension.

8. A valve guide for an intake valve of a combustion engine, the valve guide comprising:

a surface for guiding a valve stem, the surface having a first end and a second end defining a length; and a first channel formed in the surface for receiving oil from an oil reservoir;

wherein the first channel is sized to receive a volume of oil quantified to dissolve high boiling fraction from fuel to lessen the accumulation of high boiling fraction between the valve stem and the surface for guiding the valve stem.

9. The valve guide of claim 8, wherein the first channel comprises a plurality of longitudinal channels extending at least a portion of the length of the surface.

10. The valve guide of claim 8, wherein the first channel comprises a spiral having a starting point proximate the first end and an ending point proximate the second end.

11. The valve guide of claim 8, wherein the first channel is disposed proximate the second end of the surface, and further comprising:

a second channel formed in the surface and disposed between the first end and the first channel, thereby providing a fluid path from the first end, through the second channel, to the first channel.

12. The valve guide of claim 11, wherein the first channel comprises a ring-like shape.

13. A method for dissolving or diluting high boiling fraction from fuel at an intake valve stem of a combustion engine, comprising:

passing a volume of oil from a first end of a valve guide toward a second end thereof through a first channel disposed between the valve stem and the valve guide; and receiving the volume of oil at a second channel disposed at the second end of the valve guide, the volume of oil quantified to dissolve high boiling fraction from fuel to lessen the accumulation of high boiling fraction between the valve stem and the valve guide.

14. The method of claim 13, wherein the passing a volume of oil further comprises:

passing a volume of oil in a volume ratio of oil to high boiling fraction that is equal to or less than about 8-to-1.

15. The method of claim 14, wherein the passing a volume of oil further comprises:

passing a volume of oil in a volume ratio of oil to high boiling fraction that is equal to or less than about 3to-1.

* * * * *